United States Patent [19]

Wohlford

[11] 4,047,465

[45] Sept. 13, 1977

[54] TELESCOPED EXPLOSIVE DRIVER

[75] Inventor: William P. Wohlford, Bettendorf, Iowa

[73] Assignee: The United States of America as represented by the Secretary of the Army, Washington, D.C.

[21] Appl. No.: 708,163

[22] Filed: July 23, 1976

[51] Int. Cl.[2] ..... F41F 1/00

[52] U.S. Cl. ..... 89/8; 89/1 B; 102/38

[58] Field of Search ..... 89/1 B, 8; 102/38 R; 60/632

[56] References Cited

U.S. PATENT DOCUMENTS

| | | | |
|---|---|---|---|
| 3,054,329 | 9/1962 | Willig | 89/8 X |
| 3,106,131 | 10/1963 | Barr et al. | 89/1 B |
| 3,119,302 | 1/1964 | Barr | 89/1 B |
| 3,204,527 | 9/1965 | Godfrey et al. | 89/8 |
| 3,224,337 | 12/1965 | Ford et al. | 89/8 |
| 3,404,598 | 10/1968 | Angelos | 89/1 B |
| 3,465,638 | 9/1969 | Canning | 89/8 |
| 3,738,271 | 6/1973 | La Costa | 102/38 |
| 3,967,552 | 7/1976 | Settles et al. | 102/38 |

*Primary Examiner*—David H. Brown

*Attorney, Agent, or Firm*—Nathan Edelberg; Harold H. Card, Jr.; Robert O. Richardson

[57] ABSTRACT

A high velocity driver is made with a liner between the propellant and light gas medium within a cartridge casing. This casing is reduced in length and made wider to accommodate the same desired gas and propellant volume. The liner is folded over so as to form a cylinder of propellant between a central cylinder and an annular cylinder of light gas medium. The explosive gases from the propellant thus expand the liner against the light gas medium in two directions, thereby utilizing more explosive gas energy to compress the light gas medium and thus create a higher velocity ejection of the projectile from the gun barrel.

5 Claims, 4 Drawing Figures

TELESCOPED EXPLOSIVE DRIVER

GOVERNMENT RIGHTS

The invention described herein may be manufactured and/or used by or for the Government for governmental purposes without the payment of any royalty thereon.

BACKGROUND OF THE INVENTION

To provide an effective defense against tanks and other armored vehicles, the need arises for ammunition capable of penetrating armor plating. This is commonly referred to as armor-piercing ammunition. In order for an armor-piercing round to be effective, a high impact velocity of the projectile against the armored target is required. It then follows that high muzzle velocities, i.e., velocities of the projectile leaving the gun barrel or tube, are necessary to provide the required impact velocity. One method of obtaining such high muzzle velocity is by the use of what is referred to as explosive drivers. These utilize the energy of burning propellant to compress light gases into a high energy reservoir while the projectile is still in the gun tube. The gases then act on the projectile causing it to accelerate to a very high muzzle velocity. This concept provides significantly higher muzzle velocities than conventional ammunition.

Prior art drivers incorporated a central cylinder of propellant encased in a liner. The light gas would then occupy the space surrounding the liner within the outer casing. When the round is detonated, the burning propellant expands the liner outwardly against the case to compress the gas. As the liner contacts the casing the residual energy is transferred to it and therefore wasted.

In this concept the ammunition package is contained in a long slender cylinder. This leads to increased length of the weapon system to accommodate such a round.

The weapon system is best kept to a minimum length in order to be manufactured economically and to provide a weapon that can be more easily transported.

SUMMARY OF THE INVENTION

In the present invention a telescoped explosive driver is made in which the light gas is contained in a central cylinder formed by a resilient liner, and in an annular cylinder formed by the liner and the cartridge casing. The central gas cylinder is telescoped within the annular cylinder and spaced therefrom by a cylinder of propellant. The liner separates the light gas in the two gas cylinders and the propellant which forms the propellant cylinder between the two gas cylinders. Upon detonation the liner is collapsed inwardly and expanded outwardly, by the burning propellant, to compress the light gas. Since the impulse travels in two directions, significantly less energy is transmitted to the cartridge casing. The net effect is to reduce the shock imparted to the case and increase the efficiency of the round. Also by telescoping the total gas volume into central and annular cylinders, the length of the round is reduced.

The telescoped explosive driver of the present invention will result in a shorter package. The weapon system can therefore be made more compact. This would be advantageous in practically any situation but particularly when the weapon is used as vehicle armament. The present invention will also utilize more of the energy produced by the burning propellant and will attenuate the shock caused by detonation of the round.

DETAILED DESCRIPTION OF INVENTION

Figure 1:
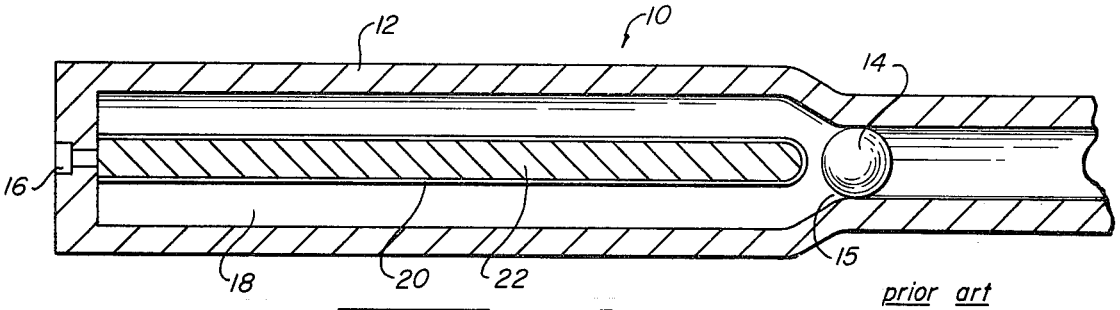
prior art FIG. 1
FIG. 1 is a sectional view of a typical prior art explosive driver.

Reference is made to FIG. 1 wherein there is shown a prior art explosive driver generally indicated by the numeral 10. This explosive driver has an outer casing-barrel combination 12 which supports a projectile 14 at the mouth 15 of the barrel section. Within the casing 12 there is contained a light gas 18 such as helium, hydrogen, or air. The light gas 18 surrounds a long cylindrical liner 20 which encases a highly explosive propellant 22. When the detonator 16 is ignited, it, in turn, ignites the propellant 22. As the propellant 22 burns, gases from combustion expand the liner 20 outwardly toward the casing 12. This action reduces the original gas volume to a much smaller reservoir volume behind the projectile 14. The gas 18, now in a highly compressed state, pushes the projectile 14 down the barrel of the weapon.

Since the liner 20 is expanded under great pressure and comparatively little energy is used to compress the light gas 18, the liner 20 is left with a great deal of energy. As the liner 20 contacts the casing 12 this residual energy is transferred to it in the form of an ultra high pressure pulse. This energy is therefore wasted. It also leaves the round somewhat inefficient and contributes to unwanted vibration and excessive recoil of the weapon system.

Figure 2:
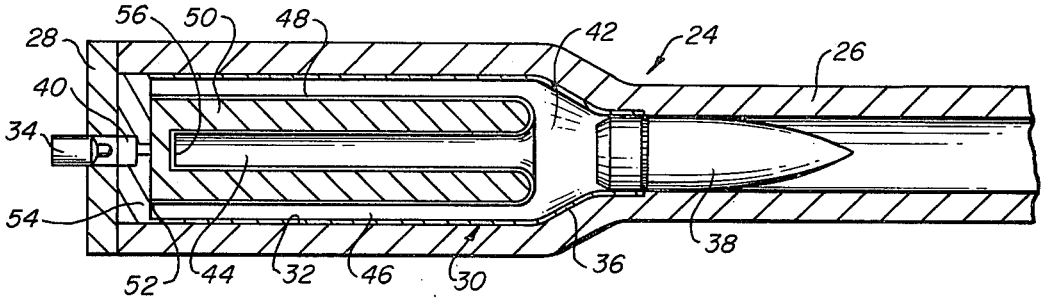
FIG. 2 is a sectional view of the explosive driver of the present invention before detonation.

In FIG. 2 there is shown a simple weapon system 24 having a barrel 26 and a breech 28. The breech 28 may be sideably or pivotally mounted to permit loading of the round into the chamber 32. The breech 28 will also carry a firing pin 34 to detonate the round.

An explosive driver 30 of the present invention is shown loaded in the weapon 24 in the before firing configuration. The outer casing 36 supports a projectile 38 at one end and a detonator 40 at the other. Again, a light gas 42 is contained within the outer casing 36. The light gas fills a central cylinder 44 and an annular cylinder 46. These cylinders are formed by the liner 48 which separates the light gas 42 from the propellant 50. This liner is fastened along its edge 52 to the inner surface of end 54 of casing 36, extends over the propellant cylinder 50 and is depressed back toward end 54 to form a pocket or central cylinder 44 for gas 42. The liner 48 is not fastened at its center 56 to end 54 although with some liner materials this may be desirable.

Figure 3:
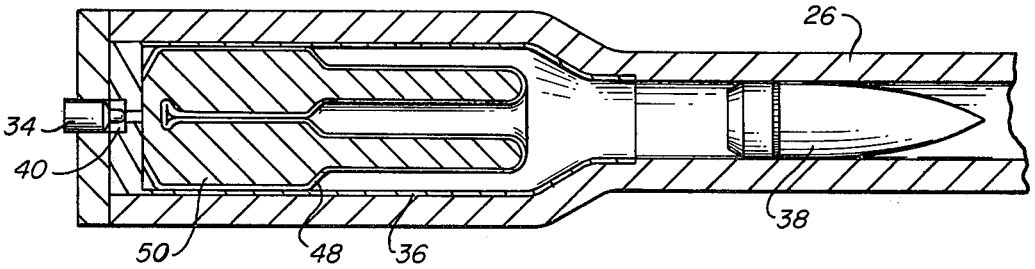
FIG. 3 is a sectional view similar to FIG. 2 showing a configuration that exists at some time between detonation of the round and the exit of the projectile from the barrel.

FIG. 3 shows that the firing pin 34 has fallen, igniting the detonator 40 which in turn ignites the propellant 50. The combustion gases of the burning propellant 50 collapse the liner 48 inwardly and expand it outwardly toward the outer case 36. The light gas 42 is displaced and therefore compressed by the deformed liner 48. The compressed gas then acts on the projectile 38, causing it to accelerate down the barrel 26.

Figure 4:
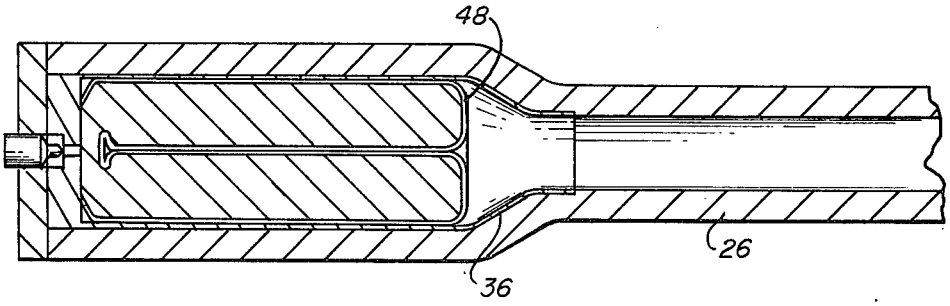
FIG. 4 is a sectional view similar to FIG. 3 showing further deformation of the liner and the projectile having moved down the barrel.

FIG. 4 illustrates the final configuration after firing. The liner 48 has been completely expanded to displace the maximum amount of gas. The projectile 38 has at this point moved further down the barrel 26. Since the liner is deformed in two directions, more efficient compression of the gas is obtained. Also more energy is used to compress the gas so less is transferred to the casing 36, therefore recoil forces and excessive vibrations are reduced.

Whereas in the illustrative embodiment two telescoped gas cylinders are spaced, by one propellant cylinder, obviously more telescoped gas and propellant cylinders may be used.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A telescoped explosive driver comprising:

a central gas cylinder, an annular gas cylinder telescoped over and spaced from said central gas cylinder, an annular propellant filled cylinder surrounding said central gas cylinder and positioned within said annular gas cylinder, said driver having a projectile at one end and propellant detonating means at the other, said propellant cylinder upon detonation expanding into and thereby compressing said gas cylinders and thereby ejecting said projectile upon expansion thereof.

2. A telescoped explosive driver as set forth in claim 1 wherein a resilient liner forms and surrounds propellant in said propellant cylinder.

3. A telescoped explosive driver as set forth in claim 1 wherein said gas cylinders are interconnected.

4. A telescoped explosive driver as set forth in claim 1, wherein said projectile and said propellant detonating means are retained in an outer casing, said outer casing forming the outer wall of said annular gas cylinder.

5. A telescoped explosive driver as set forth in claim 4 wherein a resilient liner is attached at its periphery to said outer casing, said liner extending over said propellant cylinder and depressed to form said central gas cylinder.

* * * * *